US009902531B2

(12) United States Patent
Baum et al.

(10) Patent No.: US 9,902,531 B2
(45) Date of Patent: Feb. 27, 2018

(54) END-HINGED PRODUCE CONTAINERS AND PRODUCE PACKING SYSTEM USING SAME

(71) Applicant: Pacific Agricultural Packaging, Inc., Watsonville, CA (US)

(72) Inventors: David Franz Baum, Watsonville, CA (US); Frank Nunes, Grover Beach, CA (US)

(73) Assignee: Pacific Agricultural Packaging, Inc., Watsonville, CA (US)

( * ) Notice: Subject to any disclaimer, the term of this patent is extended or adjusted under 35 U.S.C. 154(b) by 0 days.

(21) Appl. No.: 14/623,869

(22) Filed: Feb. 17, 2015

(65) Prior Publication Data

US 2016/0236829 A1 Aug. 18, 2016

(51) Int. Cl.
*B65D 43/16* (2006.01)
*B65D 85/34* (2006.01)

(52) U.S. Cl.
CPC ..... *B65D 43/162* (2013.01); *B65D 85/34* (2013.01); *B65D 2205/00* (2013.01); *B65D 2251/1033* (2013.01)

(58) Field of Classification Search
CPC .... B65D 85/34; B65D 85/345; B65D 81/263; B65D 21/0212; B65D 1/22; B65D 43/162; B65D 2005/00
USPC ..... 206/557, 503; 220/788, 23.83, 836, 831, 220/820
See application file for complete search history.

(56) References Cited

U.S. PATENT DOCUMENTS 4,618,069 A * 10/1986 Quong ..... B65D 1/36 206/509
5,730,311 A * 3/1998 Curtis ..... B65D 21/0222 206/508
7,100,788 B2 * 9/2006 Cadiente ..... B65D 1/22 220/366.1
2003/0077363 A1 * 4/2003 Cadiente ..... B65D 1/22 426/106
2005/0242098 A1 * 11/2005 Cadiente ..... B65D 43/162 220/366.1
2006/0027578 A1 * 2/2006 Cadiente ..... B65D 1/22 220/23.88
2007/0007293 A1 * 1/2007 Sambrailo ..... B65D 1/22 220/366.1
2007/0012710 A1 * 1/2007 Vovan ..... B65D 43/162 220/793
2007/0056980 A1 * 3/2007 Sambrailo ..... B65D 5/4295 220/592.01
2008/0217330 A1 * 9/2008 Baum ..... B65D 77/0413 220/23.83
2009/0134179 A1 * 5/2009 Kidd ..... B65D 43/162 220/834
2009/0223966 A1 * 9/2009 Kidd ..... B65D 75/22 220/324
2011/0139785 A1 * 6/2011 Strange ..... B65D 43/162 220/283

* cited by examiner

*Primary Examiner* — Steven A. Reynolds
(74) *Attorney, Agent, or Firm* — Michael A. Guth

(57) ABSTRACT

A container for produce adapted to open along a short end of the rectangular container. A produce packing system wherein the produce containers may be placed into a tray in such a fashion that the likelihood of a container's lid blocking another container is greatly reduced, if not wholly eliminated. The containers may have a plurality of vents.

7 Claims, 6 Drawing Sheets

END-HINGED PRODUCE CONTAINERS AND PRODUCE PACKING SYSTEM USING SAME

BACKGROUND

Field of the Invention

This invention relates to containers, and more specifically to produce containers and a system of packing using produce containers.

Description of Related Art

Today, many produce products are both harvested and packaged in the field. These produce products include, but are not limited to, berries, grapes, tomatoes, mushrooms, and other fruits and vegetables.

The harvested produce is often packed directly into ventilated containers that will be purchased by the end consumer. The containers are typically thin walled clear or semi-clear plastic and are referred to as clamshells. This may be because often the lid of the container is formed integrally to the main volume of the container and the open container gives a visual suggestion of an open clamshell. The clamshells are closed after they have been filled with the produce.

The clamshells are also adapted to facilitate the initial cooling of the produce. To this end, the clamshells have openings in various locations which allow for forced air cooling to flow through the closed clamshell and cool the produce. The clamshells are also typically placed into trays, typically made of cardboard. The trays may also have openings in various locations to facilitate the cooling air flow through the clamshells.

Currently, there are a variety of sizes of trays that may be used for different types of produce, with the different trays adapted to hold differing numbers of different size clamshells, depending upon the produce type and the intended market.

In some harvesting scenarios, the clamshell would be on the tray when the harvested produce is placed within it, as that produce is harvested in the field. Thus, the tray would be populated with clamshells, and after a set amount of harvesting all of the clamshells on a tray would be full. These clamshells could then be closed, and the next tray's clamshell containers could be filled.

What is called for is a system that allows for the produce containers be opened while on a try, and able to receive harvested produce, in such a way that no lid of any clamshell interferes with an adjacent clamshell's lower (produce carrying) section. What is also called for is a produce container adapted to support such a system.

SUMMARY

A container for produce adapted to open along a short end of the rectangular container. The produce containers may be placed into a tray in such a fashion that the likelihood of a container's lid blocking another container is greatly reduced, if not wholly eliminated. The containers may have a plurality of vents.

DETAILED DESCRIPTION

Figure 1A:
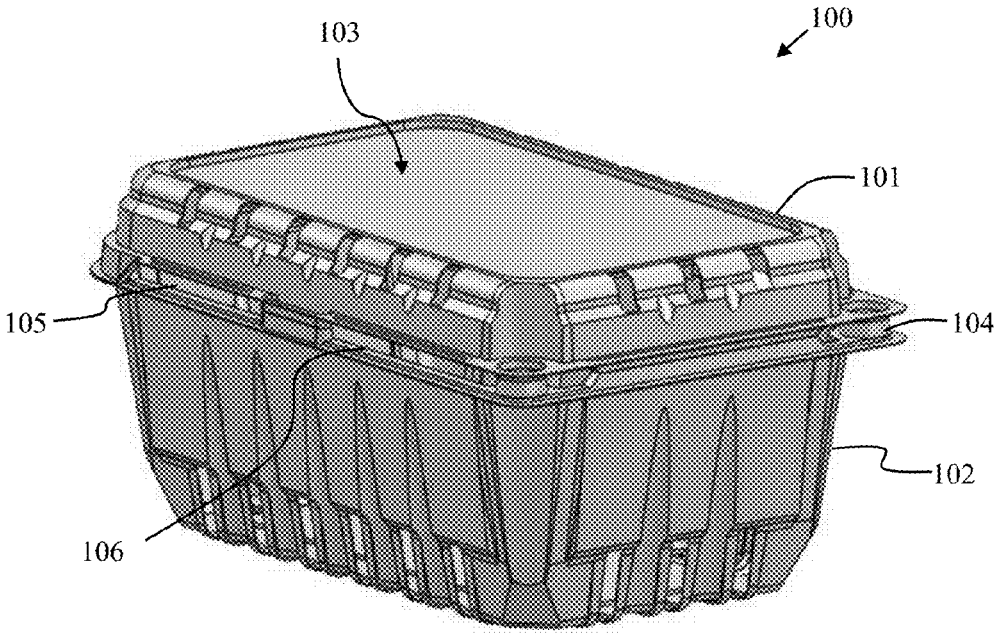
FIG. 1A is a perspective view of a closed produce carrying container according to some embodiments of the present invention.
Figure 1B:
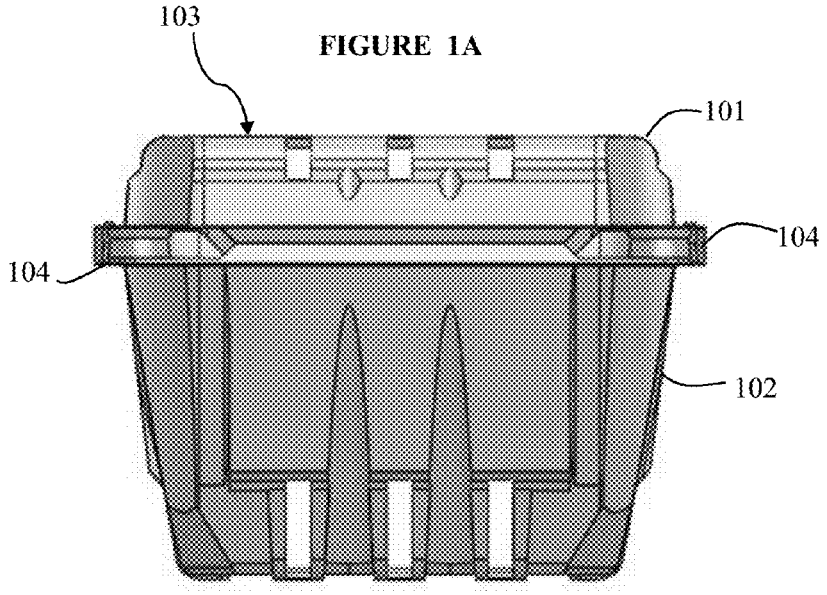
FIG. 1B is a front view of a closed produce carrying container according to some embodiments of the present invention.
Figure 1C:
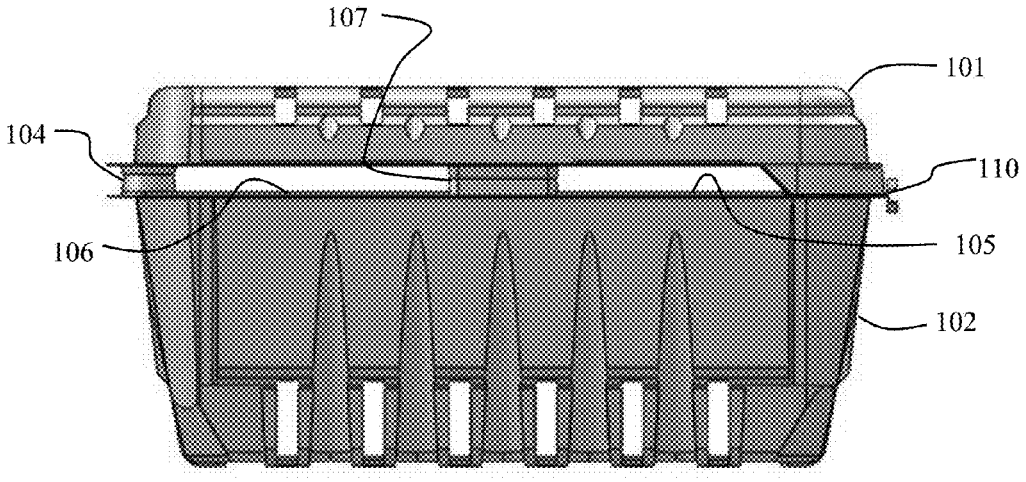
FIG. 1C is a side view of a closed produce carrying container according to some embodiments of the present invention.

FIG. 1A is a perspective view of the outer surfaces of a produce carrying container 100 in a closed configuration according to some embodiments of the present invention. FIGS. 1B and 1C are front and side views, respectively, of an end-hinged produce carrying container 100 according to some embodiments of the present invention. The produce carrying container 100 may be of unitary construction, that is, it may be constructed out of or into a single piece. The container 100 consists of a top 101 and bottom 102. The top 101 of the container 100 may be folded over and clasped using button locks 104 which have a button on the bottom 102 of the container 100 and a button receptacle on the top 101 of the container. The button locks are typically a round extrusion on one side and a mating recess on the mating piece that lock with a mild interference fit. The button locks are adapted to be locked with relatively minor force, and to be unlocked with similar force. The container 100 is substantially rectangular in nature.

Figure 2A:
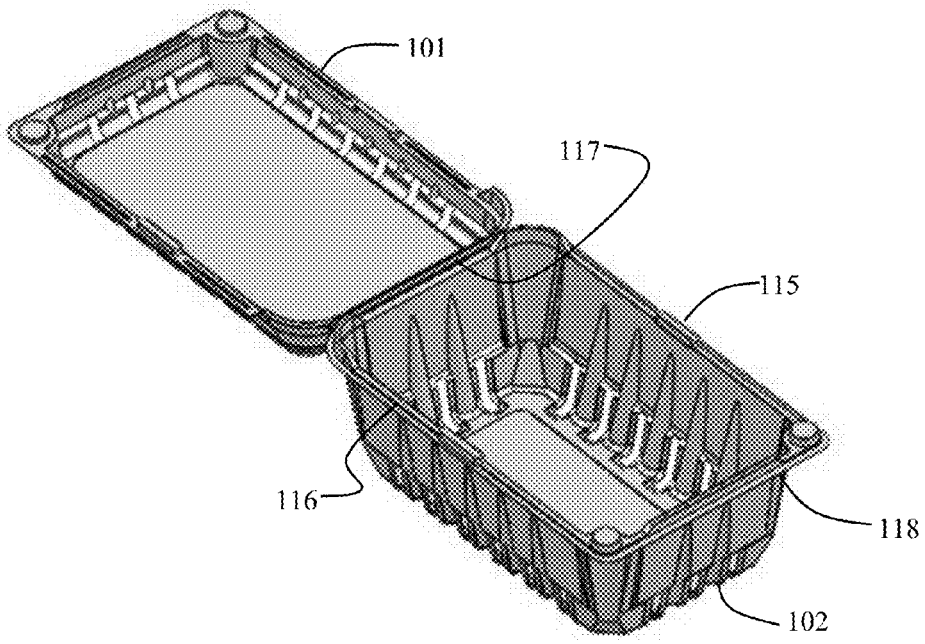
FIG. 2A is a perspective view of an open produce carrying container according to some embodiments of the present invention.
Figure 2B:
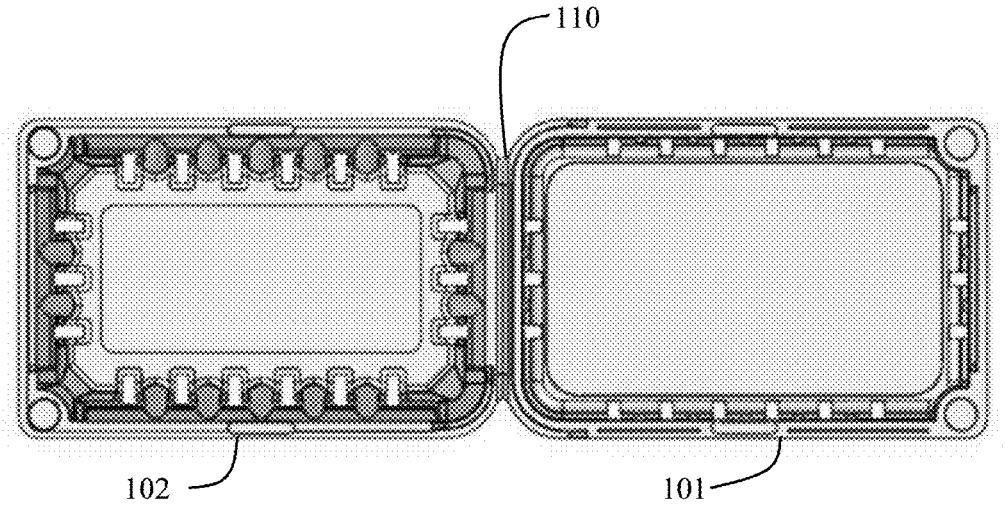
FIG. 2B is a top view of an open produce carrying container according to some embodiments of the present invention.
Figure 2C:
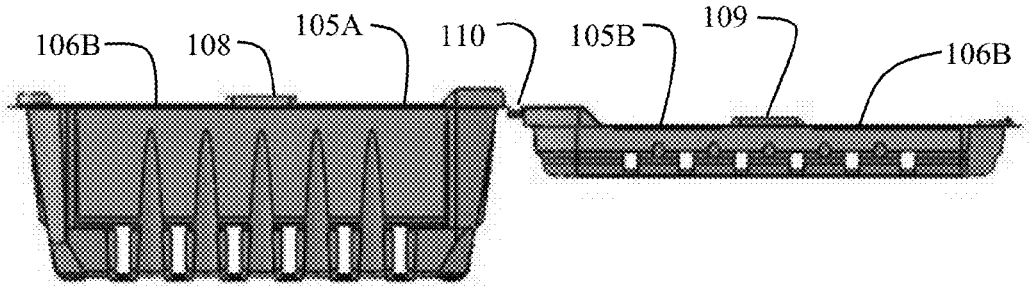
FIG. 2C is a side view of an open produce carrying container according to some embodiments of the present invention.

FIGS. 2A-C illustrated the produce carrying container 100 in an open configuration according to some embodiments of the present invention. The top 101 and the bottom 102 may be joined with a hinge feature 110. The bottom may have a first side 117 and a third side 118 of a first length, and a second side 115 and a fourth side 116 of a second length, where the first length is considerably shorter than the second length. Along the longer sides (of the first length) 115, 116 there may be vents, as well as a spacer element adapted to provide support along the vented interface area. The bottom 102 may have a vent portion 105A near the hinge 110, then a spacer element portion 108, and then a second vent portion 106A. The top may have features adapted to mate with the features just described, having a vent portion 105B near the hinge 110, a spacer element portion 109, and then a second vent portion 106B. When viewed in profile, as seen in FIG.

1C, the first vent 105 is seen as forming a through venting slot between the top 101 and the bottom 102, and the second vent 106 is seen as forming a through venting slot between the top 101 and the bottom 102. The first vent 105 and the second vent 106 may be separated by a spacer element 107, which may provide structural support to prevent the vent areas from being crushed shut when stacked, or otherwise exposed to downward force from above. The vent features described above may be seen at the interface of the top and the bottom on both the second side 115 and the fourth side 116. These vents are adapted to allow for cooling air flow, and this cooling air flow may continue through these vents along the longer side between adjacent containers, as when the containers are placed side by side in a tray. The vents allow for a significant cross-directional flow of air through the container 100. The hinge 110 may join the top to the bottom along the first side, and may do so without any venting features. The third side 118 may also seal the top to the bottom without vent features, as were seen on the second and fourth side. Having vents only on the second and fourth side may better facilitate cooling forced air flow when the containers are mounted adjacent to each other, such as in a tray.

Figure 3A:
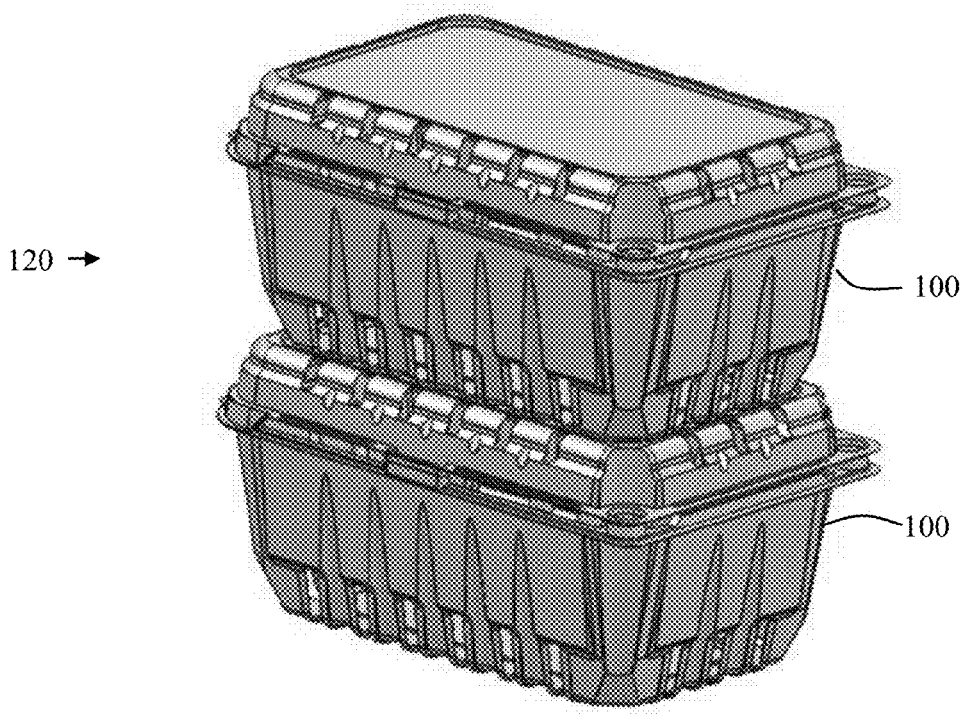
FIG. 3A is a perspective view of a stack of produce carrying containers according to some embodiments of the present invention.
Figure 3B:
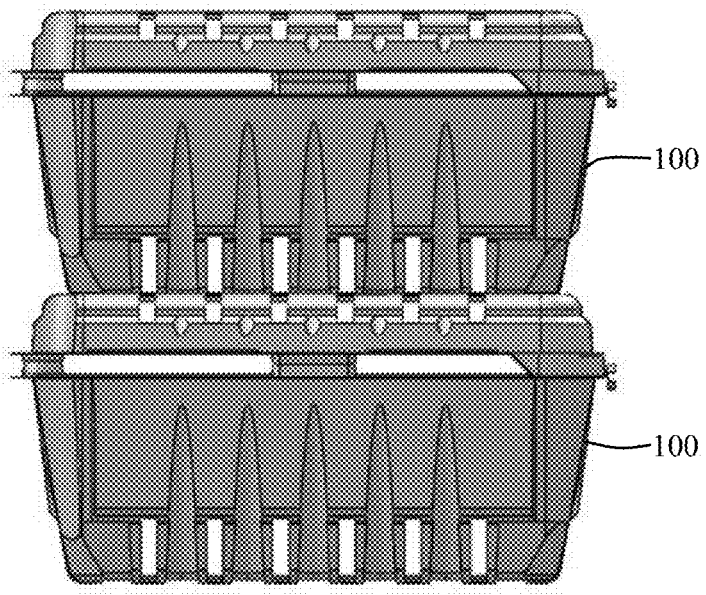
FIG. 3B is a side view of a stack of produce carrying containers according to some embodiments of the present invention.
Figure 3C:
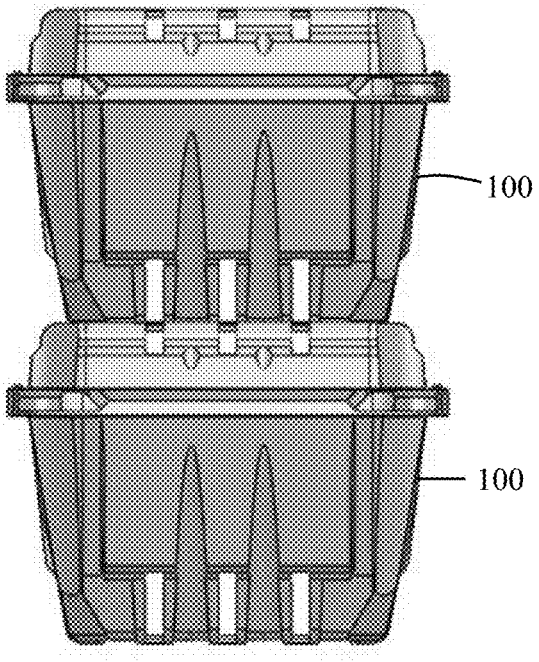
FIG. 3C is a front view of a stack of produce carrying containers according to some embodiments of the present invention.

In some embodiments, as seen in FIGS. 3A-C, a first container 100 is adapted to be stacked onto a second container 100. The top 101 may have a recessed surface 103 adapted to interlock with a mating feature on the bottom of the container when containers are stacked onto each other. The stackable aspects of the containers provide yet another aspect of use, in that the containers are adapted to be stacked in a retail setting as seen in FIG. 3A, and also adapted to be used in trays, including during harvesting in the field, as discussed below. This plurality of adapted uses adds to the versatility of the container.

Figure 4:
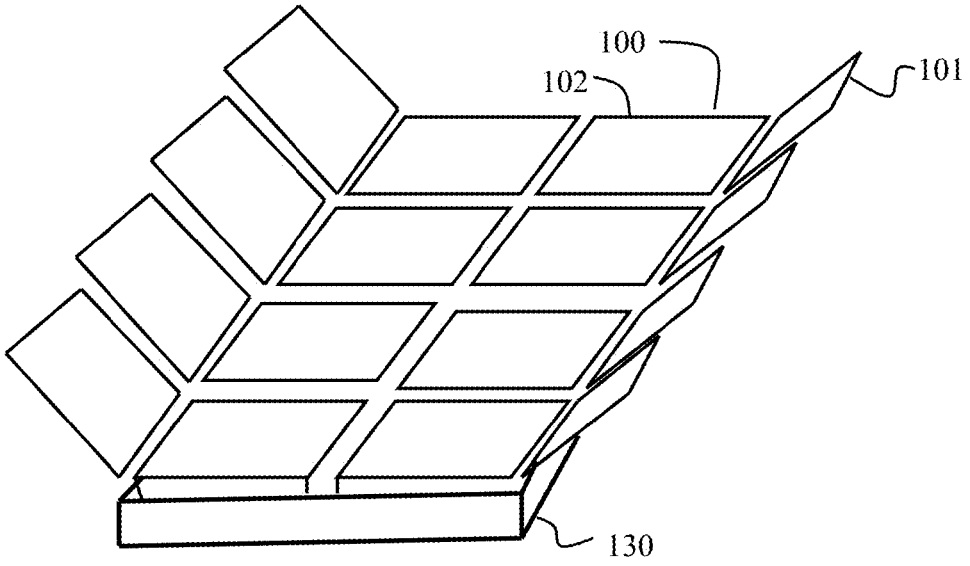
FIG. 4 is a perspective view of a tray with open produce carrying containers according to some embodiments of the present invention.

FIG. 4 illustrates an aspect of a produce packing system 140 according to some embodiments of the present invention. Using a plurality of end-hinged produce containers 100 placed into a tray 130, the produce packing system 140 provides significant improvement in harvesting and packing of produce. In an illustrative example, eight produce containers 100 are adapted to fit a tray 130. The bottoms 102 of the produce containers 100 are arranged in the tray 130 such that all of the tops 101 are able to be hinged away from all of the bottoms 102, thus no top 101 blocks, or interferes with, the placement of produce into the various bottoms that are within the tray 130.

Figure 5:
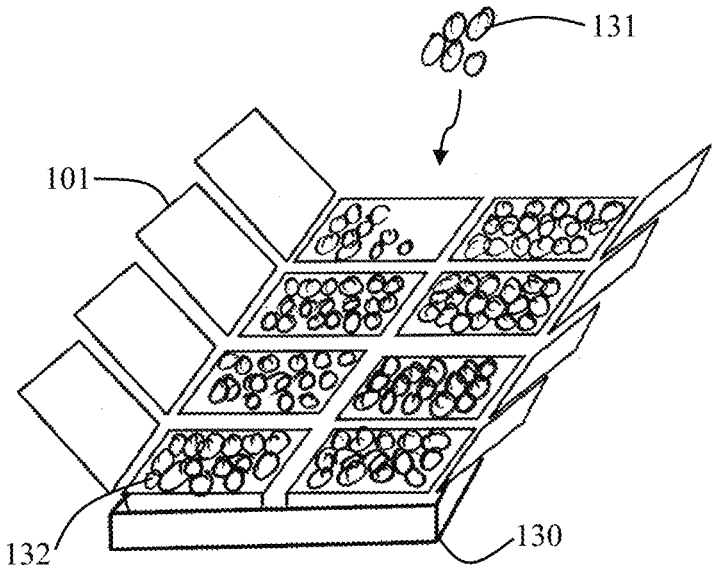
FIG. 5 is a perspective view of a tray with open produce carrying containers with produce according to some embodiments of the present invention.
Figure 6:
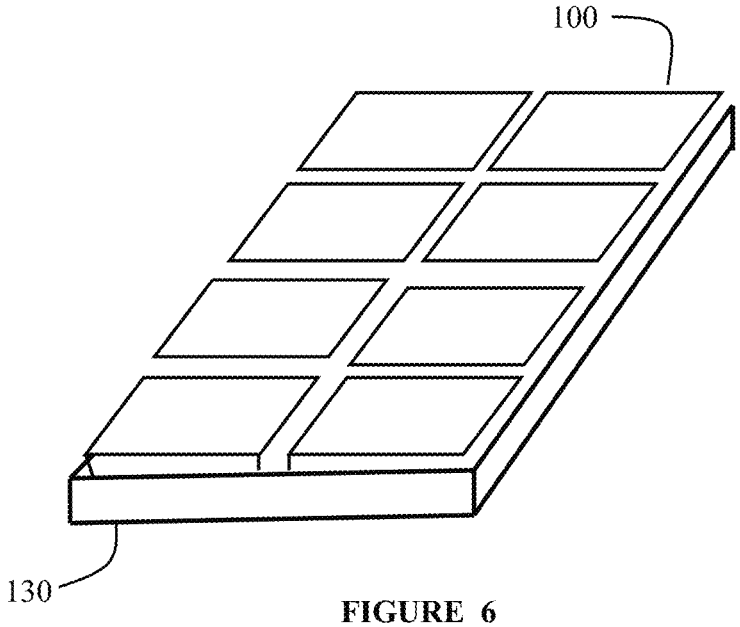
FIG. 6 is a perspective view of a tray with closed produce carrying containers with produce according to some embodiments of the present invention.

FIG. 5 illustrates a tray 130 as might be seen during harvest. Produce 131 is inserted into the various produce containers within the tray 130. A filled produce container 132 was able to be filled without physical blockage of another produce container's open top, as each top is able to be opened away from any open bottom of a produce container in this system. As seen in FIG. 6, once the produce containers are full they may be closed 133 with the produce within.

In some aspects, a tray may be used in the field with a plurality of produce containers within. The produce containers may all have end-hinging such that the tops of the open produce containers hang outside of the tray, and out of the way as produce is placed into the containers. This may allow for all of the produce containers to be filled in an efficient and even manner. Once the produce containers are filled, the tops may then be closed over the bottoms such that closed, filled, produce containers reside in the tray. Another tray could then be placed upon the top of this filled tray without risk of damage to the produce in the already filled trays.

Once a plurality of trays are filled, and the produce has filled a plurality of closed end-hinged produce containers, the trays may be cooled using a forced air cooling device. The vents at the top to bottom interface of the closed produce containers, along the long side of the produce containers, are engaged to the vents of the adjacent produce container such that the air forced into the vents at the outer edge of the tray is able to continue on through the adjacent produce containers as well.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

What is claimed is:

1. An end-hinged produce carrying container, said container comprising:

a bottom well, said bottom well substantially rectangular, said bottom well comprising a first and a third side of a first length, and a second and a fourth side of a second length, wherein said second length is significantly longer than said first length;

a top, said top comprising a raised internal portion, said top bendably attached to said bottom well along the first side, said top adapted to be folded over said bottom well into a closed position and to fit to said bottom well along said first, second, third, and fourth sides creating a top-bottom interface along said first, second, third, and fourth sides; and a plurality of vent spaces between said top and said bottom well along said second and said fourth sides, wherein there are no vents along the top-bottom interface along the first and third sides.

2. The end-hinged produce carrying container of claim 1 further comprising structural support spacer elements within said vent spaces.

3. The end-hinged produce carrying container of claim 1 wherein said top and said bottom well are made of a continuous unitary molded piece.

4. The end-hinged produce carrying container of claim 2 wherein said top and said bottom well are made of a continuous unitary molded piece.

5. The end-hinged produce carrying container of claim 1 further comprising button locks adapted to fasten said top to said bottom well in a closed position.

6. The end-hinged produce carrying container of claim 2 further comprising button locks adapted to fasten said top to said bottom well in a closed position.

7. A produce packing system, said produce packing system comprising:

a tray, said tray adapted to hold eight containers;

eight produce containers, said produce containers comprising:

a bottom well, said bottom well substantially rectangular, said bottom well comprising a first and a third side of a first length, and a second and a fourth side of a second length, wherein said second length is significantly longer than said first length;

a top, said top comprising a raised internal portion, said top bendably attached to said bottom well along the first side, said top adapted to be folded over said bottom well into a closed position and to fit to said bottom well along said first, second, third, and fourth sides creating a top-bottom interface along said first, second, third, and fourth sides; and a plurality of vent spaces between said top and said bottom well along said second and said fourth sides, wherein there are no vents along the top-bottom interface along the first and third sides, wherein each of said produce containers adapted to be configured into said tray such that each of said tops of said produce containers is able to be reconfigured from a first configuration where a top is closed onto the bottom well of the produce container, to a second configuration wherein the top is hinged open, and wherein the top does not block access to any of said bottom wells while in said second configuration, and wherein said first side of each produce container abuts said tray, allowing for said top of each produce container to be hinged over the edge of said tray.

* * * * *